US006976274B1

(12) United States Patent
Dufresne

(10) Patent No.: US 6,976,274 B1
(45) Date of Patent: Dec. 20, 2005

(54) TRAFFIC CONTROL GLOVE

(76) Inventor: Rhonda E. Dufresne, 186 Mass Ave., Lunenburg, MA (US) 01462

( * ) Notice: Subject to any disclaimer, the term of this patent is extended or adjusted under 35 U.S.C. 154(b) by 0 days.

(21) Appl. No.: 10/465,152

(22) Filed: Jun. 19, 2003

Related U.S. Application Data

(60) Provisional application No. 60/389,776, filed on Jun. 19, 2002.

(51) Int. Cl.[7] ..... A41D 19/00
(52) U.S. Cl. ..... 2/161.6; 359/517
(58) Field of Search ..... 2/161, 161.6; 359/517; 40/586

(56) References Cited

U.S. PATENT DOCUMENTS

| | | | | | |
|---|---|---|---|---|---|
| 1,244,065 | A | | 10/1917 | Miller | |
| 1,520,693 | A | | 12/1924 | Brown | |
| 1,630,730 | A | * | 5/1927 | Daugherty | 116/35 R |
| 1,670,176 | A | | 5/1928 | Woolery | |
| 1,772,305 | A | | 8/1930 | Chamberland | |
| 1,966,822 | A | | 7/1934 | Liab | |
| 2,092,574 | A | | 9/1937 | Eddy | |
| 2,317,227 | A | * | 4/1943 | Sherwood | 359/517 |
| 2,581,549 | A | * | 1/1952 | McGaugh | 359/517 |
| 2,787,236 | A | * | 4/1957 | Welch | 359/517 |
| 4,543,671 | A | * | 10/1985 | Monk | 2/158 |
| 5,433,025 | A | | 7/1995 | Borghese | |
| D369,309 | S | | 4/1996 | Marbach | |
| 5,694,711 | A | * | 12/1997 | Cowgill et al. | 40/610 |
| 5,898,942 | A | * | 5/1999 | Anderson | 2/159 |
| 6,006,357 | A | | 12/1999 | Mead | |

* cited by examiner

*Primary Examiner*—Katherine M. Moran
(74) *Attorney, Agent, or Firm*—Blodgett & Blodgett, P.C.

(57) ABSTRACT

A new safety glove for allowing a user, such as a police officer or a road worker, to direct traffic more easily. The inventive device includes a hand cover having an interior hand space, a front or palm panel and a back or dorsal panel the two panel being fastened to each other on three sides to form the interior hand space and open on one side to form a wrist opening into the interior hand space. The exterior surfaces of the palm and rear panels are brightly and reflectively or retro-reflectively colored; the palm panel being red and the rear panel being green. A pocket, with a closure, in one of the panels is provided to carry a self-contained warming device for keeping the user's hand warm. The palm panel may bear a brightly colored octagonal stop sign including the word "STOP". The fingers portions of the panels might have a reflective or retro-reflective arrow shape pointing to the finger ends, to increase the visibility of the fingers as they point in a direction.

3 Claims, 4 Drawing Sheets

TRAFFIC CONTROL GLOVE

CROSS-REFERENCE TO RELATED APPLICATIONS

This application claims the benefit under 35 U.S.C. §119 (e) of prior U.S. Provisional Application No. 60/389,776 filed Jun. 19, 2002; which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

1. Field of the Invention

The present invention relates to glove devices and more particularly pertains to a new safety glove for allowing a user, such as a police officer or a road worker, to direct traffic more easily.

2. Description of the Prior Art

The use of glove devices is known in the prior art. More specifically, glove devices heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the aforementioned patents do not disclose the new traffic control glove described herein. The present inventive device includes a hand cover having an interior hand space, a front or palm panel and a back or dorsal panel the panel being fastened to one another on three sides to form the interior hand space and open on one side to form a wrist opening into the interior hand space. The exterior surfaces of the palm and rear panels are brightly and reflectively or retro-reflectively colored; the palm panel being red and the rear panel being green. A pocket, with a closure, in one of the panels is provided to carry a self-contained warming device for keeping the user's hand warm. The palm panel may bear a brightly colored octagonal stop sign including the word "STOP". The fingers portions of the panels might have a reflective or retro-reflective arrow shape pointing to the finger ends, to increase the visibility of the fingers as they point in a direction.

In these respects, the safety glove according to the present invention substantially departs from the conventional concepts and designs of the prior art, and in so doing provides an apparatus primarily developed for the purpose of allowing a user, such as a police officer or a road worker, to direct traffic more easily.

SUMMARY OF THE INVENTION

In view of the foregoing disadvantages inherent in the known types of glove devices now present in the prior art, the present invention provides a new traffic control and safety glove construction wherein the same can be utilized for allowing a user, such as a police officer or a road worker, to direct traffic more easily.

It is frequently the case that, when vehicle driver are sitting in a line of traffic in which a police officer was directing it, the drivers can not tell if the police officer wants the cars to stop or continue moving. If the police officer were wearing a special glove or mitten on his hand and the glove or mitten have a bright red palm panel and a bright green rear or dorsal panel, then the police officer could very effectively communicate to the drivers by exposing the red palm to the driver to communicate "STOP", and by exposing the rear green panel to communicate "GO". Because when the officer put his hand out to stop, it is the palm that you see and that would be "red", and when the police officer turns his hand the other way, waving on traffic to start, the rear of his hand is visible, which will be green. This glove should have night reflective surfaces for safety. The glove or mitten will have a pocket to hold a self-powered warmer to keep the user's hand warm in the winter.

The present inventive device includes a hand cover having an interior hand space, a palm panel and a back or dorsal panel fastened on three sides to form the interior hand space and open on one side to form a wrist opening into the interior hand space. The exterior surfaces of the palm and rear panels are brightly and reflectively or retro-reflectively colored; the palm panel being red and the rear panel being green. A pocket, with a closure, in one of the panels is provided to carry a self-contained warming device for keeping the user's hand warm. The palm panel may bear a brightly colored octagonal stop sign including the word "STOP". The fingers portions of the panels might have a reflective or retro-reflective arrow shape pointing to the finger ends, to increase the visibility of the fingers as they point in a direction.

The general purpose of the present invention, which will be described subsequently in greater detail, is to provide a new traffic control and safety glove apparatus and method which has many of the advantages of the glove devices mentioned heretofore and many novel features that result in a new safety glove which is not anticipated, rendered obvious, suggested, or even implied by any of the prior art glove devices, either alone or in any combination thereof.

To attain this, the present invention generally comprises a hand cover having an interior hand space, a front or palm panel, a rear, back or dorsal panel, the panel being bonded together of three sides, and a wrist opening into the interior hand space on the fourth side of the panels.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract of the Disclosure associated with this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new traffic control and safety glove apparatus and method which has many of the advantages of the glove devices mentioned heretofore and many novel features that result in a new safety glove which is not anticipated, rendered obvious, suggested, or even implied by any of the prior art glove devices, either alone or in any combination thereof.

It is another object of the present invention to provide a new traffic control and safety glove which may be easily and efficiently manufactured and marketed.

It is a further object of the present invention to provide a new traffic control and safety glove which is of a durable and reliable construction.

An even further object of the present invention is to provide a new traffic control and safety glove which is susceptible of a low cost of manufacture with regard to both materials and labor, and which accordingly is then susceptible of low prices of sale to the consuming public, thereby making such safety glove economically available to the buying public.

Still yet another object of the present invention is to provide a new traffic control and safety glove which provides in the apparatuses and methods of the prior art some of the advantages thereof, while simultaneously overcoming some of the disadvantages normally associated therewith.

Still another object of the present invention is to provide a new traffic control and safety glove for allowing a user, such as a police officer or a road worker, to direct traffic more easily.

Yet another object of the present invention is to provide a new traffic control and safety glove which includes a hand cover having an interior hand space, a front or palm red-colored panel and a rear or dorsal green-colored panel, each panel being bonded together on three sides to form the interior space, and a wrist opening into the interior hand space on the fourth side.

Still yet another object of the present invention is to provide a new traffic control and safety glove that has integral panels for reflecting or retro-reflecting colored light so that others can easily see the hands of the user. This is very helpful when directing vehicular traffic by hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
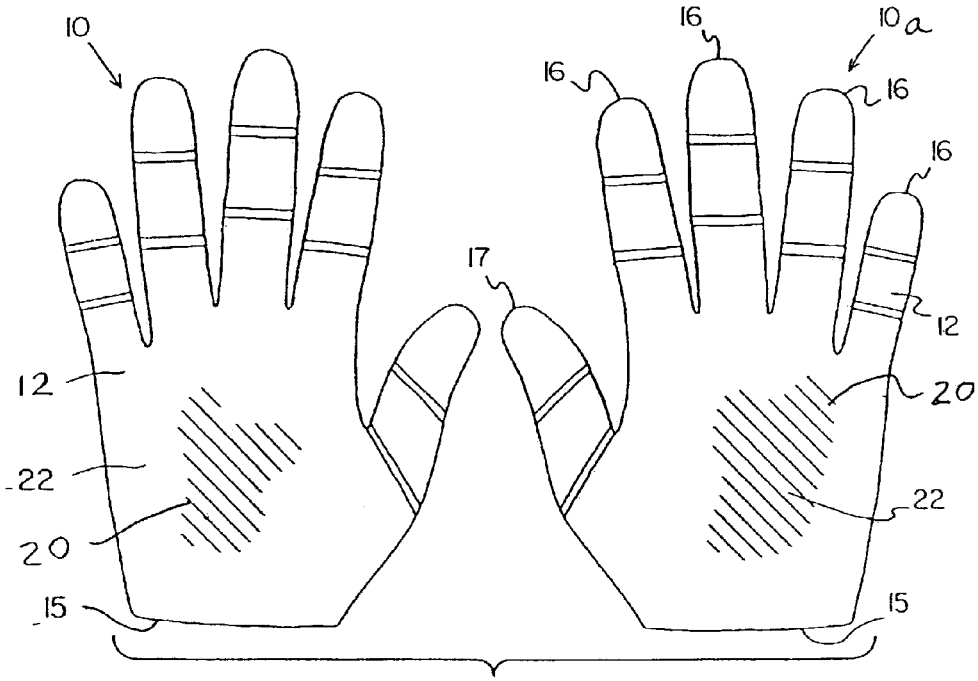
FIG. 1 is a front view of the front or palm side of a pair of glove embodiment hand covers of a new safety glove according to the present invention.

As best illustrated in FIGS. 1 through 8, the safety glove generally comprises a hand cover (glove or mitten, respectively) 10 or 11 having an interior hand space, a front or palm panel 12, and a rear or dorsal panel 13. The palm panel 12 and the rear panel 13 are bonded together on three sides to form the hand cover 10. The fourth side provides a wrist opening 15 for the hand into the interior hand space. The exterior surfaces 22 and 23 of the palm panel 12 and the rear panel 13 respectively are colored red 20 and green 21 respectively and are preferably reflective or retro-reflective so that the colors are highly visible.

Figure 8:
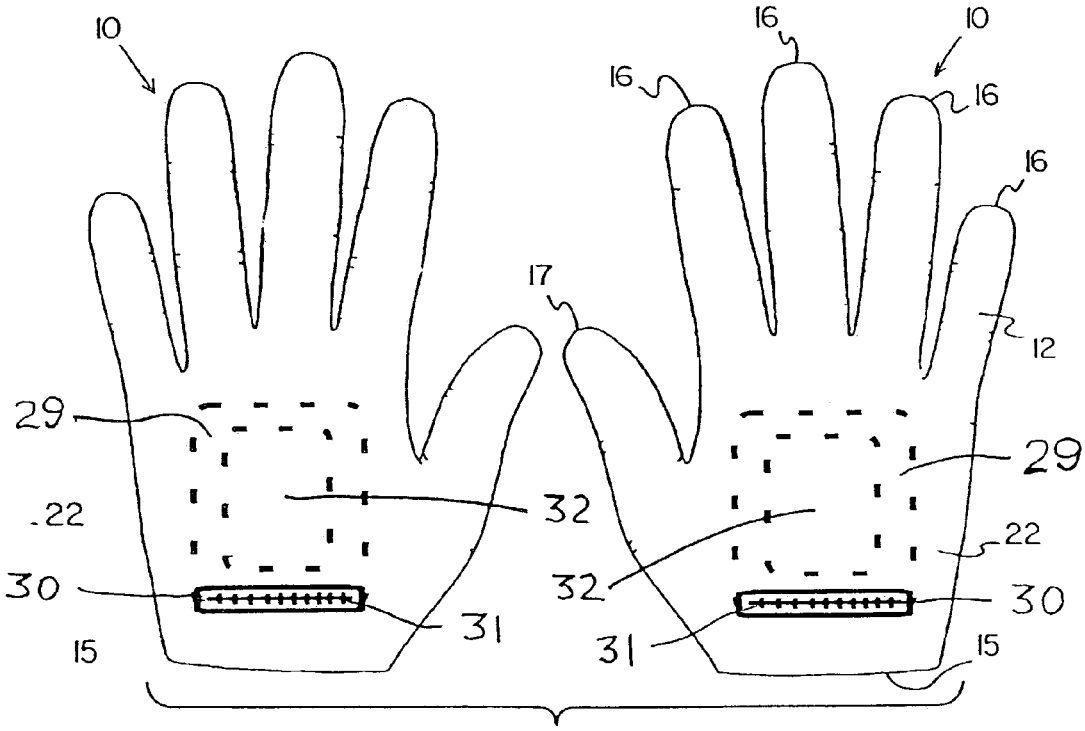
FIG. 8 is a rear view of the back or dorsal side of the inside surface of a pair of a glove embodiment hand covers of the present invention, showing the heater and heater pocket in dashed lines.

In the preferred embodiment, the band cover, and preferably the palm, has heater pocket 29, shown in dashed lines in FIG. 8, with an opening 30, preferably inside, but alternatively outside the hand cover, and a closure 31 for the opening. The pocket is adapted to hold a self-powered heater 32, shown in dashed lines, which can provide heat to the user's hands during cold weather use.

Figure 6:
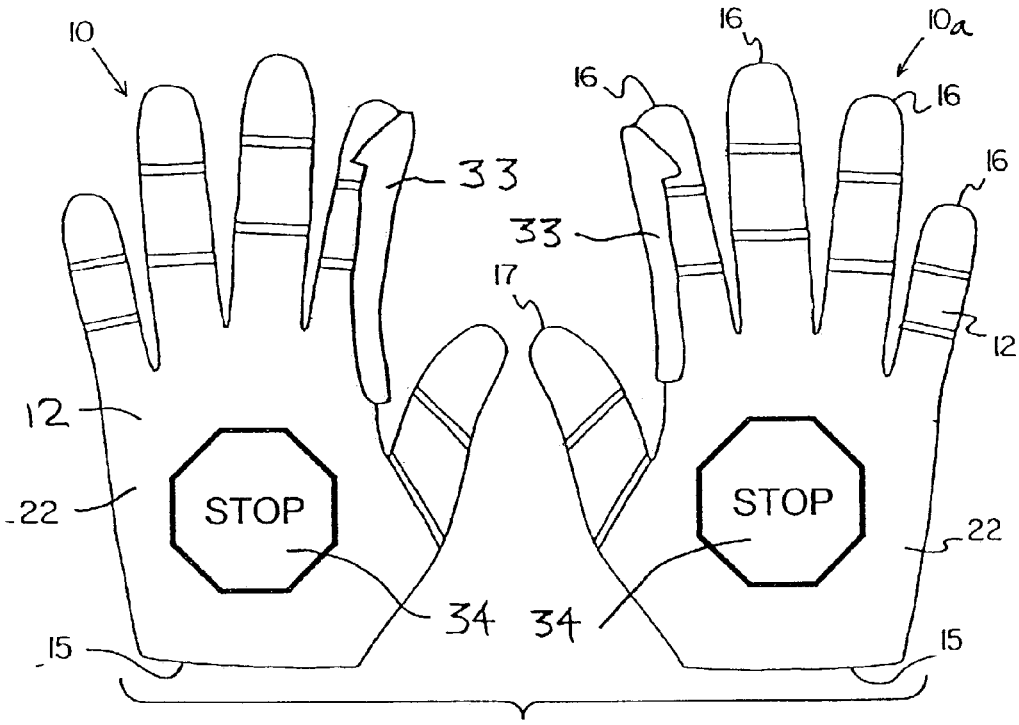
FIG. 6 is a front view of the front or palm side of a pair of another glove embodiment hand covers of a new safety glove according to the present invention.
Figure 7:
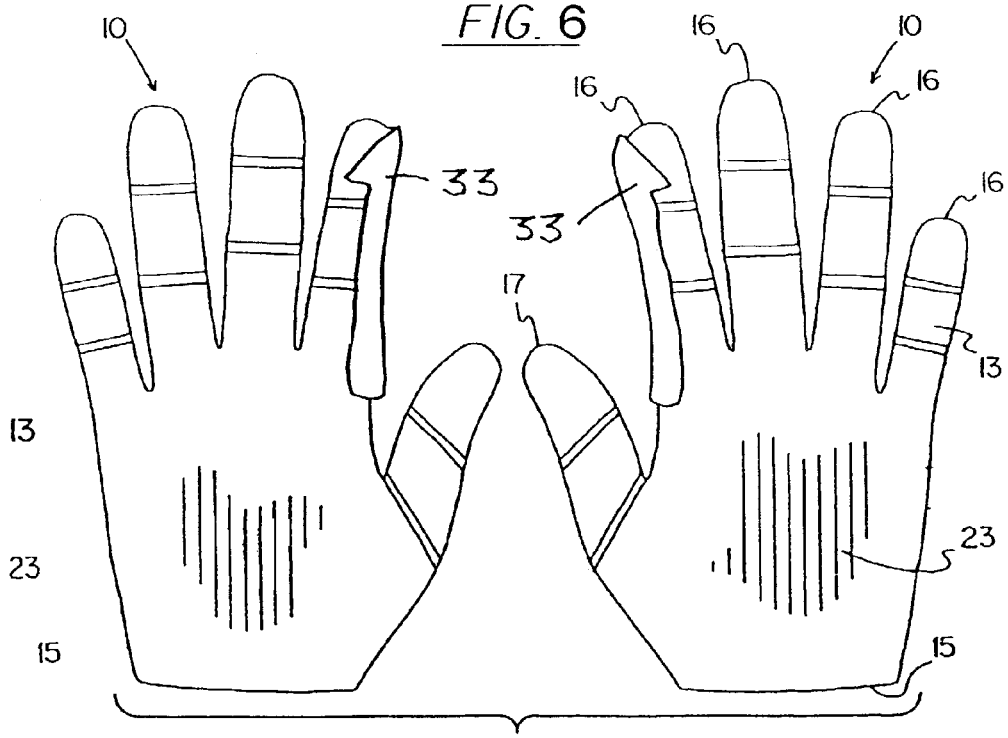
FIG. 7 is a rear view of the back or dorsal side of a pair of another glove embodiment hand covers of the present invention.

The outside of the glove and preferably the outside peripheral edge of the index finger portion of the glove may have a highly visible arrow 33, preferably pointing to the end of the finger. The exterior of the palm panel 12 may also bear a highly visible octagonal image 34 with the word "STOP" as shown in FIG. 6.

Figure 2:
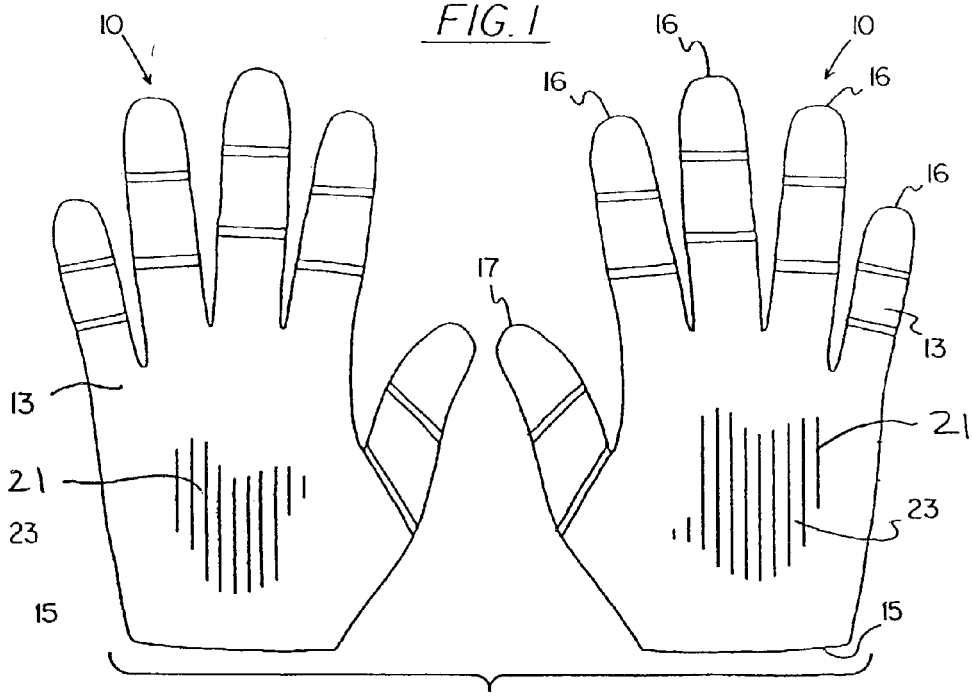
FIG. 2 is a rear view of the rear or dorsal side of a pair of glove embodiment hand covers of the present invention.
Figure 3:
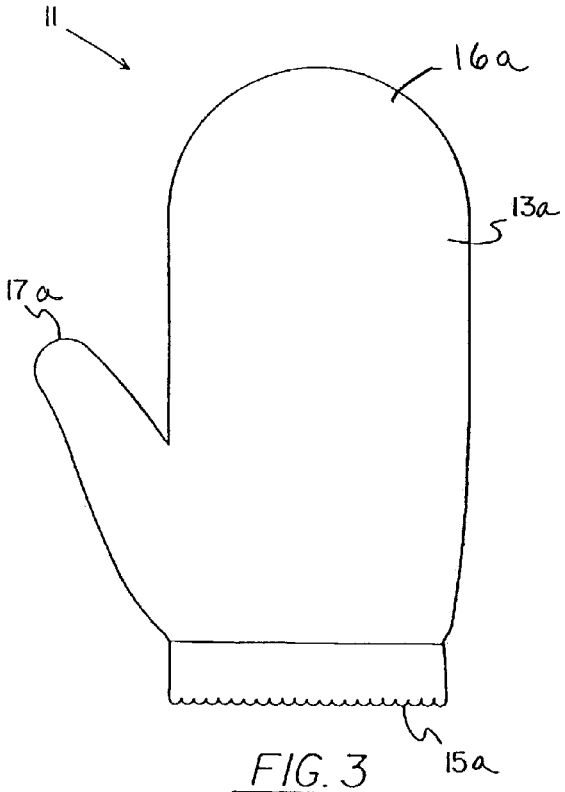
FIG. 3 is a front view of the mitten embodiment of the present invention.
Figure 4:
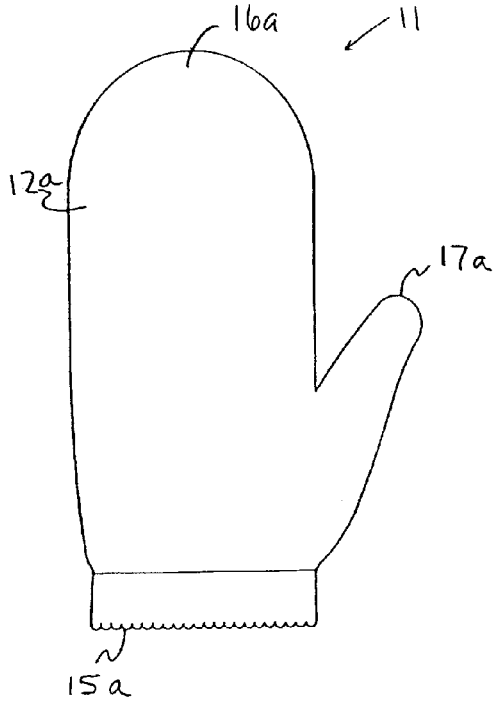
FIG. 4 is a rear view of the mitten embodiment of the present invention.
Figure 5:
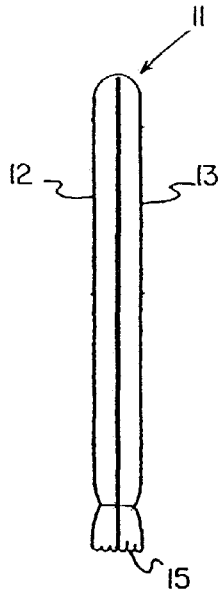
FIG. 5 is a side view of the mitten embodiment of the present invention.

In closer detail, as illustrated in the Figures, the safety hand garment preferably includes right and left hand covers 10 and 10*a* respectively. As illustrated in FIGS. 1 and 2, ideally, the hand cover may comprise a glove 10 having a plurality of finger portions 16 and a thumb portion 17 or a mitten 11 having a thumb portion 17*a* and a finger portion 16*a*. In either embodiment each hand cover has an interior hand space, a front or palm panel 12*a*, a rear or dorsal panel 13*a*, and a wrist opening 15*a* into the interior hand space.

The panels 12 and 13 each have a highly visible colored reflective or retro-reflective outer surface 22 and 23 respectively, designed for reflecting light. The reflective surface 22 of the front reflective panel 12 is of a first color such that light of the first color is reflected to be viewed by others. The reflective surface 23 of the back reflective panel 13 is of a second color such that light of the second color is reflected to be viewed by others. Preferably, the first color is distinguishable from the second color. Ideally, the first color is red for symbolizing "stop" when directing traffic with the hand cover and the second color is green for symbolizing "go" when directing traffic with the hand cover.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A traffic control glove or mitten, comprising:

(a) a hand cover having an interior hand space, including;

(b) a palm panel;

(c) a back panel;

(d) a wrist opening;

wherein the two panels are fastened to each other on three sides to form the interior hand space and are open on one side to form a wrist opening into the interior hand space;

wherein the exterior surface of the palm panel is brightly colored red in the same hue as a standard stop sign and is reflective or retro-reflective;

(e) a octagonal stop sign including the word "STOP" on the palm panel, said sign being brightly colored and being reflective or retro-reflective; and (f) a pocket on the inside of the panels within the interior hand space to carry a self-contained warming device for keeping the user's band warm.

2. A traffic control glove or mitten as recited in claim 1, wherein the hand cover and panels are divided into finger portion, one of which is provided with a reflective or retro-reflective arrow shape pointing to the finger portion end, to increase the visibility of the finger portion as it points in a direction.

3. A traffic control glove as recited in claim 1, wherein the exterior surface of the back panel is brightly colored green and is reflective or retro-reflective.

* * * * *